US009670418B2

(12) United States Patent
Schmidt et al.

(10) Patent No.: US 9,670,418 B2
(45) **Date of Patent: *Jun. 6, 2017**

(54) PROCESS FOR PREPARING OLEFINS BY THERMAL STEAMCRACKING

(71) Applicant: Linde Aktiengesellschaft, Munich (DE)

(72) Inventors: Gunther Schmidt, Deisenhofen (DE); Helmut Fritz, Munich (DE); Stefanie Walter, Seehausen (DE)

(73) Assignee: Linde Aktiengesellschaft, München (DE)

( * ) Notice: Subject to any disclaimer, the term of this patent is extended or adjusted under 35 U.S.C. 154(b) by 73 days.

This patent is subject to a terminal disclaimer.

(21) Appl. No.: 14/420,636

(22) PCT Filed: Aug. 6, 2013

(86) PCT No.: PCT/EP2013/002348

§ 371 (c)(1),
(2) Date: Feb. 9, 2015

(87) PCT Pub. No.: WO2014/023418

PCT Pub. Date: Feb. 13, 2014

(65) Prior Publication Data

US 2015/0315484 A1 Nov. 5, 2015

(30) Foreign Application Priority Data

Aug. 9, 2012 (EP) ..... 12005783

(51) Int. Cl.
*C10G 9/36* (2006.01)

(52) U.S. Cl.
CPC ..... *C10G 9/36* (2013.01); *C10G 2400/20* (2013.01)

(58) Field of Classification Search
None
See application file for complete search history.

(56) References Cited

U.S. PATENT DOCUMENTS 6,743,961 B2 6/2004 Powers
2004/0209964 A1 10/2004 Ansorge
(Continued)

FOREIGN PATENT DOCUMENTS

CN 1665911 A 9/2005
EP 1365004 A1 11/2003
(Continued)

OTHER PUBLICATIONS

Chinese application No. 201380040762.8, English Translation of First Office Action dated Jan. 20, 2016, 11 pages.
(Continued)

*Primary Examiner* — Tam M Nguyen
(74) *Attorney, Agent, or Firm* — Lathrop & Gage LLP

(57) ABSTRACT

The invention relates to a process for converting hydrocarbon inputs by thermal steamcracking to give at least one olefin-containing product stream comprising at least ethylene and propylene, by at least partly converting a hydrocarbon input in at least one cracking furnace (2), wherein the hydrocarbon input is converted under mild cracking conditions in the cracking furnace (2), mild cracking conditions meaning that propylene to ethylene are present in a ratio of 0.81 to 1.6 kg/kg at the cracking furnace exit, and the hydrocarbon input comprising predominantly hydrocarbons having a maximum carbon number of 6, preferably a maximum of 5.

15 Claims, 3 Drawing Sheets

(56) References Cited

U.S. PATENT DOCUMENTS

| | | | |
|---|---|---|---|
| 2008/0194900 | A1 | 8/2008 | Bhirud |
| 2008/0223754 | A1 | 9/2008 | Subramanian |

FOREIGN PATENT DOCUMENTS

| | | | |
|---|---|---|---|
| FR | 1196927 | A | 11/1959 |
| GB | 1357495 | A | 6/1974 |

OTHER PUBLICATIONS

Ren, T. et al: "Olefins from conventional and heavy feedstocks: Energy use in steam cracking and alternative processes," Energy, 2006, pp. 425-451. vol. 31. No. 4., Pergamon Press, Oxford.
PCT/EP2013/002348 English Translation of the International Preliminary Report on Patentability mailed Nov. 26, 2014, 7 pages.
PCT/EP2013/002348 English Translation of the International Search Report mailed Oct. 23, 2013, 3 pages.

PROCESS FOR PREPARING OLEFINS BY THERMAL STEAMCRACKING

The present invention relates to a process for converting hydrocarbon inputs by thermal steamcracking to at least one olefin-containing product stream comprising at least ethylene and propylene, with at least partial conversion of a hydrocarbon input in at least one cracking furnace.

Thermal steamcracking is a long-established petrochemical process. The standard target compound in thermal steamcracking is ethylene (also referred to as ethene), which is an important starting compound for a number of chemical syntheses.

The inputs used for the thermal steamcracking may be either gases such as ethane, propane or butane and corresponding mixtures or liquid hydrocarbons, for example naphtha, and hydrocarbon mixtures.

With regard to the specific apparatuses and reaction conditions used in thermal steamcracking, and with regard to the reactions which proceed and to details of refinery technology, reference is made to corresponding articles in reference works such as Zimmermann, H. and Walzl, R.: Ethylene, in: Ullmann's Encyclopedia of Industrial Chemistry, 6th ed. Weinheim: Wiley-VCH, 2005, and Mon, W. W. and Neuwirth, O. S.: Oil Refining, in: Ullmann's Encyclopedia of Industrial Chemistry. 6th ed. Weinheim: Wiley-VCH 2005. Process for preparing olefins are also disclosed, for example, in U.S. Pat. No. 3,714,282 A and U.S. Pat. No. 6,743,961 B1.

In addition, US 2008/0194900 should also be mentioned here, and this discloses a process for steamcracking a naphtha input comprising aromatics, wherein the aromatics are removed from the pretreated naphtha input in the aromatics extraction of the steamcracker prior to the thermal steamcracking, and the raffinate obtained in the aromatics extraction is conducted into the furnace together with hydrocarbons having six to eight carbons.

For thermal steamcracking, cracking furnaces are used. The cracking furnaces, together with a quench unit and downstream devices for processing of the product mixtures formed, are integrated into corresponding larger plants for olefin production, which are referred to in the context of this application as "steamcrackers".

An important parameter in thermal steamcracking is the cracking severity, which determines the cracking conditions. The cracking conditions are influenced especially by the temperature and residence time and the partial pressures of the hydrocarbons and of the steam. The composition of the hydrocarbon mixtures used as the input and the design of the cracking furnaces used also influence the cracking conditions. Because of the mutual influences of these factors, the cracking conditions are normally defined via the ratio of propylene (also referred to as propene) to ethylene in the cracking gas.

According to the input mixture and cracking conditions, thermal steamcracking gives rise not only to ethylene, the conventional target compound, but also to sometimes considerable amounts of by-products, which can be separated from a corresponding product stream. These include lower alkenes, for example propylene and butenes, and also dienes, for example butadienes, and also aromatics, for example benzene, toluene and xylenes. These are of comparatively high economic value, and so the formation thereof as "high-value products" is desirable.

The problem addressed by the present invention is therefore that of improving the means of obtaining olefin-containing product mixtures from hydrocarbons by thermal steamcracking.

DISCLOSURE OF THE INVENTION

Against this background, the invention proposes a process for converting hydrocarbon inputs by thermal steamcracking to at least one olefin-containing product stream comprising at least ethylene and propylene, with at least partial conversion of a hydrocarbon input in at least one cracking furnace, having the features of the independent claims. Preferred configurations are the subject of the dependent claims and of the description which follows.

Advantages of the Invention

According to the invention, a process is proposed in which the hydrocarbon input is converted under mild cracking conditions in the cracking furnace, mild cracking conditions meaning that propylene to ethylene are present in a ratio of 0.81 to 1.6 kg/kg at the cracking furnace exit, and the hydrocarbon input comprising predominantly hydrocarbons having a maximum carbon number of 6, preferably a maximum of 5.

A cracking furnace is understood in the context of this invention to mean a cracking unit in which the cracking conditions are defined. It is possible that a subdivision into two or more cracking furnaces is present in one overall furnace. In that case, reference is frequently made to furnace cells. A plurality of furnace cells forming part of an overall furnace generally have independent radiation zones and a common convection zone, and also a common smoke outlet. In these cases, each furnace cell can be operated with its own cracking conditions. Each furnace cell is thus a cracking unit and is consequently referred to here as a cracking furnace. In that case, the overall furnace has a plurality of cracking units or, in other words, it has a plurality of cracking furnaces. If only one furnace cell is present, this is the cracking unit and hence the cracking furnace. Cracking furnaces can be combined to form groups, which are supplied, for example with the same input. The cracking conditions within a furnace group are generally the same or similar.

The thermal cracking of hydrocarbons of typical composition, for example naphtha, under mild cracking conditions gives rise to a very large amount of pyrolysis gasoline, which is very difficult to deal with because of the large amount. This is a result of the comparatively lower conversion of the input in the cracking furnace under mild cracking conditions. Mild cracking conditions, however, are desirable since a greater ratio of propylene to ethylene is present in the case of cracking under mild conditions than in the case of cracking under normal cracking conditions as typically used.

The process according to the invention makes it possible to operate a cracking furnace under mild cracking conditions, since the input and cracking conditions are matched to one another. Only through the matching of input and cracking conditions is it possible to avoid the disadvantages described in the previous paragraph. These disadvantages and the solution indicated have been recognized in the context of the invention.

The process according to the invention thus makes it possible to operate a steamcracking plant in such a way that more propylene is formed in relation to the fresh input than in a conventional plant in which the process according to the invention is not used.

The higher the ratio of propylene to ethylene selected for the cracking conditions in the second cracking furnace, the more propylene is formed in relation to the fresh input. This is advantageous in the context of the invention. However, a higher ratio of propylene to ethylene is associated with a lower conversion of the feedstock, and so the values are subject to upper technical and economic limits. Within the limits specified in the claims, it is guaranteed that, on the one hand, the inventive advantages will be achieved and, on the other hand, the steamcracker will be controllable in an industrial context and operable in an economically viable manner.

Within the limits specified for the cracking conditions in the cracking furnace which converts under mild conditions, industrially and economically advantageous steamcracking is possible, which forms ethylene and propylene as primary products of value.

The word "predominantly" is used in the context of this application to make it clear that the input or the fraction does not consist exclusively of hydrocarbons having the specified carbon number, but that hydrocarbons having other carbon numbers and other impurities may also be present alongside the hydrocarbons of the specified carbon number. The separation and processing of the product stream, of a starting stream and/or the fractions and/or fresh input fractionation always leaves residues of the component(s) in the product stream or in the fraction. Other impurities also persist, and so a processed product stream or fraction stream always contains residues. Since the cost and inconvenience associated with separation and processing rise to an extremely high degree with the purity to be achieved, economic factors decide what proportion of residues may be present in a stream. The level of this proportion has to be weighed up according to economic considerations. A rough guide value for the proportion of unwanted hydrocarbons and other impurities will generally be that not more than 40 percent by weight may be present in the product stream and/or in the fraction. Usually, a maximum value of 20 percent by weight or less is actually attained.

Ideally, a maximum value of 10 percent by weight is attained. The statements just made apply to all processing plants, i.e. not just in steamcrackers but also in mineral oil refineries. Consequently, the hydrocarbon input which is conducted in the cracking furnace which converts under mild conditions contains at least 60 percent by weight, preferably at least 80 percent by weight and further preferably at least 90 percent by weight and more preferably at least 95 percent by weight and most preferably at least 98 percent by weight of hydrocarbons having a maximum carbon number of 6, preferably a maximum of 5. The recycled fractions and the fractions which are obtained in the fresh input fractionation (see below) too contain the desired hydrocarbons at at least 60 percent by weight, preferably at least 80 percent by weight and further preferably at least 90 percent by weight and more preferably at least 95 percent by weight and most preferably at least 98 percent by weight.

In a particularly advantageous configuration of the invention, the cracking furnace which converts under mild cracking conditions is supplied with one or more fractions which are obtained from the product stream and which comprise predominantly hydrocarbons having a maximum carbon number of 5 as the hydrocarbon input. Recycling of such fractions increases the amount of suitable input for the second cracking furnace, or such a fraction constitutes a suitable hydrocarbon input for the cracking furnace which converts under mild cracking conditions. A fraction comprising hydrocarbons having a carbon number of 4 and a fraction having a carbon number of 5 are also obtained in the processing of the product stream in steamcrackers, and these, after separation of the products of value, can be recycled directly or after further treatment steps.

In an advantageous configuration of the invention, the recycled fractions are substantially free of diolefins when they are supplied to the cracking furnace which converts under mild cracking conditions as the hydrocarbon input. Diolefins have disadvantageous effects in a cracking furnace. For this purpose, the diolefins are predominantly removed by upstream conversion processes or separation steps from the fractions which are recycled into the second cracking furnace. The removal may either precede or follow the separation of the fractions which are recycled.

The procedures necessary for separation and processing are known to those skilled in the art. These are measures customary in steamcrackers for separation and processing of product and fraction streams Particularly advantageously, the cracking furnace which converts under mild cracking conditions is supplied with predominantly saturated hydrocarbons as the hydrocarbon input. Saturated hydrocarbons are particularly suitable for thermal steamcracking.

Advantageously, the hydrocarbon input is converted in the cracking furnace under mild cracking conditions that lead to a ratio of propylene to ethylene of 0.82 to 1.4 kg/kg, more preferably of 0.85 to 1.2 kg/kg, at the cracking furnace exit.

In an advantageous configuration, a hydrocarbon input is converted under normal cracking conditions in a further cracking furnace, normal cracking conditions meaning that propylene to ethylene are present in a ratio of 0.25 to 0.85 kg/kg, preferably of 0.3 to 0.75 kg/kg and more preferably of 0.4 to 0.65 kg/kg at the cracking furnace exit, the ratio of propylene to ethylene for the cracking furnace which converts under mild cracking conditions always having a greater value than the value for the ratio of propylene to ethylene for the cracking furnace which converts under normal cracking conditions. More particularly, the values for the ratio of propylene to ethylene differ by at least 0.1 kg/kg, preferably by at least 0.15 kg/kg, more preferably by at least 0.2 kg/kg, for the advantages of the invention to be achieved to a particular degree.

Particularly advantageously, the steamcracker thus has at least one cracking furnace which converts under normal cracking conditions. The input conducted into this steamcracker comprises hydrocarbons which are disadvantageous for the cracking furnace which converts under mild cracking conditions. The presence of at least one cracking furnace which converts under normal cracking conditions makes it economically advantageous to operate the cracking furnace which converts under mild cracking conditions when the fresh input present is a mixture of hydrocarbons which do not meet the condition specified in claim 1.

Thus, particularly advantageously, the composition of a hydrocarbon input which is used for the cracking furnace which converts under normal cracking conditions differs from that of the hydrocarbon input which is used for the cracking furnace which converts under mild cracking conditions.

Since the cracking furnace which converts under normal cracking conditions is of very good suitability for conversion of long-chain hydrocarbons, the cracking furnace which converts under normal cracking conditions is supplied with at least one fraction which has been separated from the product stream and recycled, comprising predominantly hydrocarbons having a carbon number of at least 6. Since certain hydrocarbons become enriched in recycled fractions as a result of the circulation, it is advisable in the case of recycled fractions to convert hydrocarbons having a carbon number of 6 at an early stage under normal cracking conditions. However, it is also possible to recycle these into the cracking furnace which converts under mild cracking conditions.

In a particularly advantageous configuration, a fresh input is used, which is fractionated into at least one first and one second fresh input fraction, and the first fresh input fraction is conducted at least partly, advantageously fully, into the cracking furnace which converts under normal cracking conditions and the second fresh input fraction at least partly, advantageously fully, into the cracking furnace which converts under mild cracking conditions. A fractionation of the fresh input can achieve the effect that, particularly for the cracking furnace which converts under mild cracking conditions, an input is available which can achieve the advantages of the invention in an outstanding manner.

It should be emphasized once again here that the aforementioned inputs (recycled fractions, fresh input fraction and fresh inputs composed of hydrocarbons having a maximum carbon number of 6, preferably a maximum of 5) are particularly suitable as inputs for the cracking furnace which converts under mild cracking conditions. In order to gain the advantages of the invention, the inputs proposed here can be conducted individually or as a mixture into the cracking furnace which converts under mild cracking conditions. The hydrocarbon input used may thus be one or more recycled fractions or a fresh input fraction or another input composed of hydrocarbons having a maximum carbon number of 6, preferably a maximum of 5. It is also possible to use recycled fraction(s) and a fresh input fraction or recycled fraction(s) and another input composed of hydrocarbons having a maximum carbon number of 6 or a fresh input fraction and another input composed of hydrocarbons having a maximum carbon number of 6 or a mixture of all the possible inputs as the hydrocarbon input for the cracking furnace which converts under mild cracking conditions.

As explained at the outset, the ratio of propylene to ethylene in the thermal steamcracking operation results from a number of different influencing factors, among which the cracking furnace exit temperature, i.e. the temperature of a product stream on departure from the reactor coil used (coil output temperature), plays an important role. The cracking furnace exit temperature for the conversion in the cracking furnace which converts under mild cracking conditions is advantageously between 680° C. and 820° C., preferably between 700° C. and 800° C. and further preferably between 710° C. and 780° C. and more preferably between 720° C. and 760° C. The cracking furnace exit temperature for the conversion in the cracking furnace which converts under normal cracking conditions is advantageously between 800° C. and 1000° C., preferably between 820° C. and 950° C. and more preferably between 840° C. and 900° C. At the same time, the cracking furnace exit temperature for the conversion in the cracking furnace which converts under normal cracking conditions is at least 10° C. above, preferably at least 20° C. above, that of the cracking furnace which converts under mild cracking conditions.

In the cracking furnace which converts under mild cracking conditions, it is also possible to use lower steam dilution than in the cracking furnace which converts under normal cracking conditions. This reduces the amount of dilution steam needed and saves energy. However, a lower steam dilution in the second cracking furnace is unnecessary for the significant advantages of the invention to be manifested. Advantageously, 0.3 to 1.5 kg of steam per kg of hydrocarbon input is used in the cracking furnace which converts under normal cracking conditions, and 0.15 to 0.8 kg of steam per kg of hydrocarbon input in the cracking furnace which converts under mild cracking conditions.

It is also advantageously possible to convert especially saturated hydrocarbons having a carbon number of 2 to 3 present in the product stream advantageously by means of thermal steamcracking in a cracking furnace for gaseous input. To this end, the saturated gaseous hydrocarbons are obtained from the product stream, and recycled into and converted in the cracking furnace for gaseous input.

Advantageously, the fresh input conducted into the cracking furnace which converts under mild cracking conditions comprises natural gas condensates or/and one or more cuts from a mineral oil refinery and/or synthetic and/or biogenic hydrocarbons and/or mixtures derived therefrom.

The fresh inputs used for the cracking furnace which converts under normal cracking conditions or/and the fresh inputs used for fresh input fractionation may be either gases or gas fractions, such as ethane, propane or butane, and corresponding mixtures and condensates, or liquid hydrocarbons and hydrocarbon mixtures. These gas mixtures and condensates comprise especially what are called natural gas condensates (natural gas liquids, NGL). The liquid hydrocarbons and hydrocarbon mixtures may originate, for example from what is called the gasoline fraction of crude oil. Such crude gasolines or naphthas (NT) and kerosene are mixtures of preferably saturated compounds having boiling points between 35 and 210° C. However, the invention is also advantageous in the case of use of middle distillates, atmospheric residues and/or mixtures derived therefrom from crude oil processing. Middle distillates comprise what are called light and heavy gas oils which can be used as starting materials for production of light heating and diesel oils and of heavy heating oil. The compounds present have boiling points of 180 to 360° C. They are preferably predominantly saturated compounds which can be converted in a thermal steamcracking operation. In addition, it is also possible to use fractions obtained by known distillative separation processes and corresponding residues, but also the use of fractions derived therefrom, for example by hydrogenation (hydrotreating) or hydrocracking. Examples are light, heavy and vacuum gas oil (atmospheric gas oil, AGO, or vacuum gas oil, VGO), and also mixtures and/or residues treated by the hydrogenation processes mentioned (hydrotreated vacuum gas oil, HVGO, hydrocracker residue, HCR, or unconverted oil, UCO).

More particularly, the fresh inputs used are natural gas condensates and/or mineral oil fractions and/or mixtures derived therefrom.

Advantageously, the invention thus encompasses the use of hydrocarbon mixtures having a boiling range of up to 600° C. as the hydrocarbon input as fresh input for the hydrocarbon input which converts under normal cracking conditions. Within this overall range, it is also possible to use hydrocarbon mixtures having different boiling ranges, for example having boiling ranges of up to 360° C. or of up to 240° C. The reaction conditions in the cracking furnace are matched here to the hydrocarbon mixtures used in each case.

For instance, the invention can, however, also advantageously be used with any desired fresh inputs having comparable properties, for example biogenic or/and synthetic hydrocarbons.

BRIEF DESCRIPTION OF THE DRAWING

The process according to the invention in a particularly advantageous configuration is to be elucidated in detail with reference to the process flow diagrams which show the essential process steps in schematic form. For better understanding, the known process is first illustrated with reference to FIG. 1.

Figure 1:
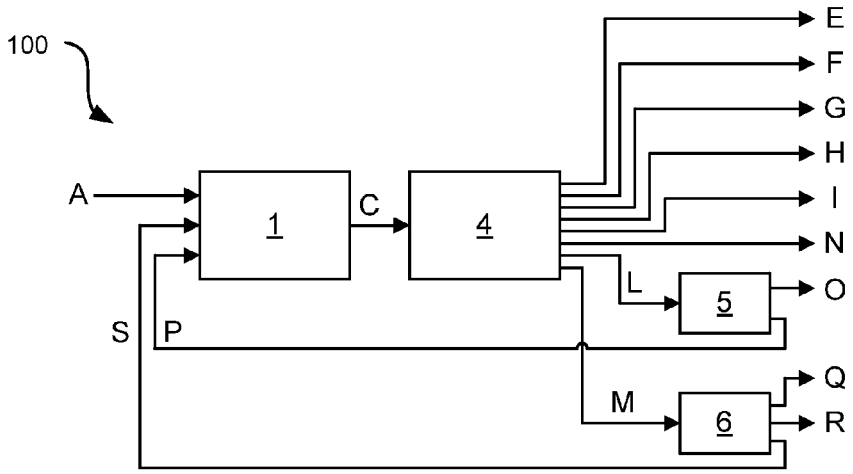
FIG. 1 shows a schematic view of a known method for olefin production.

The schematic process flow diagram 100 of FIG. 1 for the known process includes a cracking furnace 1 into which the fresh input A (for example naphtha) and the recycled fractions S and P as hydrocarbon inputs are conducted. In the cracking furnace 1, the hydrocarbon input is heated and converted in convection and radiation zones. Steam is added to the cracking furnace, usually 0.5 to 1 kg of process steam per kg of hydrocarbon. A product stream C emerges from the cracking furnace 1, and this is also referred to as the cracking product stream directly at the exit from the cracking furnace. On exit from the cracking furnace, this cracking product stream has a temperature normally between 840° C. and 900° C. The ratio of propylene to ethylene is generally 0.35 to 0.6 kg/kg. After a first quench (not shown), the product stream is processed in a processing unit 4. From the processing unit, the following fractions are obtained as essential fractions E to N: hydrogen E, waste liquor F, methane G, ethylene H, propylene I, gaseous hydrocarbons L having a carbon number of 4, pyrolysis gasoline M and pyrolysis oil N. The gaseous hydrocarbons L having a hydrocarbon number of 4 are treated further in a C4 processing unit 5, which is utilized for the processing of hydrocarbons having a carbon number of 4. Such a C4 processing unit 5 treats the fraction having a carbon number of 4 further in such a way that butadiene O can be removed. The other hydrocarbons having a carbon number of 4 constitute a fraction P which is recycled into the cracking furnace 1. The pyrolysis gasoline M comprising hydrocarbons having a carbon number of 5 or more is processed further in a pyrolysis gasoline processing unit 6, and aromatics Q and hydrocarbons R having a carbon number of, for example, more than 9 are removed. The other hydrocarbons having a carbon number of 5 or more are recycled as fraction S into the cracking furnace 1. The processing unit 4, and also the C4 processing unit 5 and the pyrolysis gasoline processing unit 6, comprise customary units for further processing of the product stream or of the product fractions, which serve to execute various process steps, for example compression, condensation and cooling, drying, distillation and fractionation, extraction and hydrogenation. The process steps are customary in olefin plants and are known to those skilled in the art.

Figure 2:
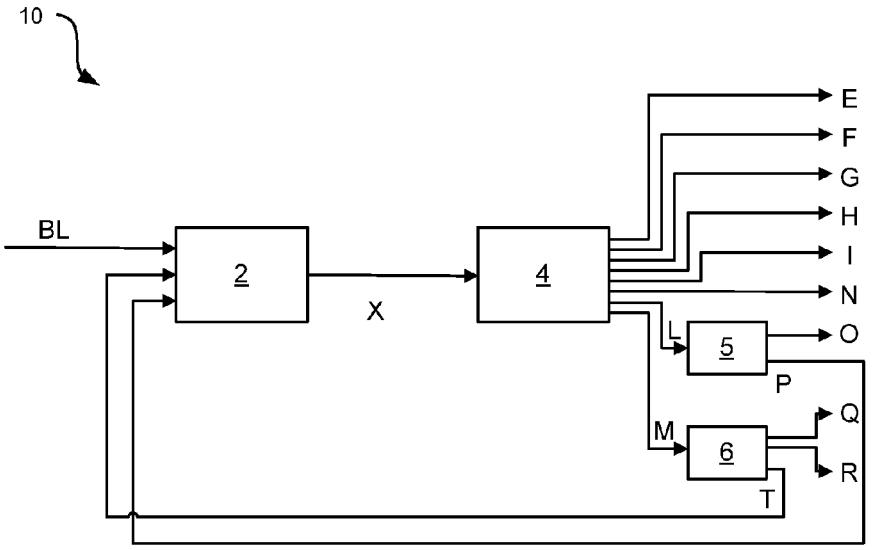
FIG. 2 shows a schematic view of the essential steps of the process according to the invention in a particularly advantageous configuration.

The schematic process flow diagram 10 of FIG. 2 then shows the essential steps of the process according to the invention. A fresh input BL is conducted into the cracking furnace 2 which converts under mild cracking conditions. The product stream X which leaves the cracking furnace 2 has a temperature advantageously between 700° C. and 800° C. The ratio of propylene to ethylene therein is advantageously between 0.7 and 1.5 kg/kg. The product stream X is processed further in the processing unit 4. The processes for further treatment and processing in the processing unit 4 are known and have just been described. Thus, the processing unit 4 also leads, as just described, to the product fractions E to N. The product fractions L and M too, as just described, are treated further in the specific processing units 5 and 6. In contrast to the process described in FIG. 1, the fraction P comprising hydrocarbons having a carbon number of 4 is advantageously recycled into the cracking furnace 2. In the pyrolysis gasoline processing unit 6, as well as the abovementioned fractions Q and R, the fraction T is obtained. The fraction T, comprising hydrocarbons having a carbon number of 5, is advantageously recycled into the cracking furnace 2 which converts under mild cracking conditions.

Figure 3:
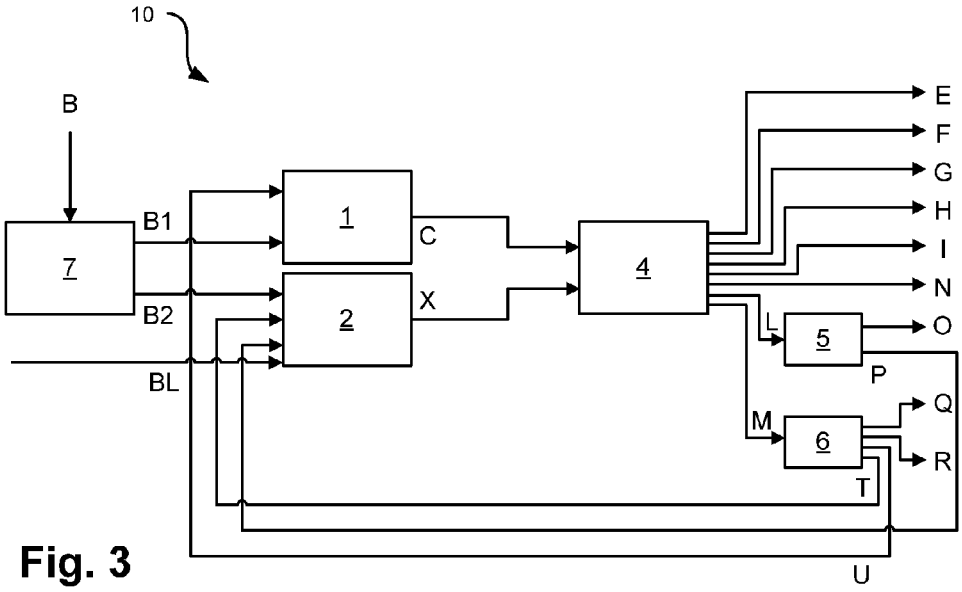
FIGS. 3, 4 and 5 show, likewise in schematic form, the essential steps of a particularly advantageous configuration of the invention. In the figures, corresponding elements bear identical reference numerals.

The schematic process flow diagram 10 of FIG. 3 then shows the process according to the invention in a particularly advantageous configuration, and the essential process steps thereof. In addition to the cracking furnace 1 which converts under normal cracking conditions, a cracking furnace 2 which converts under mild cracking conditions is also present here, as is, advantageously, a fresh input fractionation unit 7. A fresh input B (for example naphtha) is then fractionated in the fresh input fractionation unit 7 and the first fresh input fraction B1 is conducted into the cracking furnace 1, while the second fresh input fraction B2 is conducted into the cracking furnace 2. For the processes for fractionation of the fresh input, the customary methods for separation and treatment of hydrocarbon streams are used, as known from olefin plants from refineries. The person skilled in the art knows of these, and how to use them. A fraction U is additionally recycled into the cracking furnace 1, and fractions T and P are additionally recycled into the cracking furnace 2 (for further details see below). In addition, the cracking furnace 2 which converts under mild cracking conditions is supplied with a further input BL composed of hydrocarbons having a maximum carbon number of 6, preferably a maximum of 5, as a fresh input. In turn, the cracking product stream C having the abovementioned properties emerges from the cracking furnace 1. The cracking product stream X emerges from the cracking furnace 2. The cracking product stream X is at a temperature advantageously between 700° C. and 800° C. The ratio of propylene to ethylene therein is advantageously between 0.7 and 1.5 kg/kg. The product streams C and X are processed further in the processing unit 4 and combined at a suitable point to give a common product stream. The processes for further treatment and processing in the processing unit 4 are known and have just been described. Thus, the processing unit 4 also leads, as just described, to the product fractions E to N. The product fractions L and M too, as just described, are treated further in the specific processing units 5 and 6. In contrast to the process described in FIG. 1, the fraction P comprising hydrocarbons having a carbon number of 4 is advantageously also recycled not into the cracking furnace 1 but into the cracking furnace 2. In the pyrolysis gasoline processing unit 6, as well as the abovementioned fractions Q and R, the fractions T and U are obtained. The fraction T comprising hydrocarbons having a carbon number of 5 is advantageously recycled into the cracking furnace 2, while the fraction U comprising hydrocarbons having a carbon number of 6 or more, especially between 6 and 9, is advantageously recycled into the cracking furnace 1. In FIG. 3, various inputs for the cracking furnace are conducted. These then form the second hydrocarbon input. It should be mentioned that the enumeration of the various inputs is not conclusive and, more particularly, that the inputs shown in FIG. 3 for the second cracking furnace B2, BL, T and P need not always all be conducted into the cracking furnace 2; instead, it is sufficient in many cases to conduct some of the possible inputs into the cracking furnace 2 which converts under mild cracking conditions, for example a recycled fraction T composed of hydrocarbons having a carbon number of 5 and a fresh input BL composed of hydrocarbons having a maximum carbon number of 6, preferably a maximum of 5, or, for example, recycled fractions T and P comprising hydrocarbons having carbon numbers of 5 and 4 and LPG BL. In short, the following inputs into the second cracking furnace are possible: B2, BL, T, P, B2+BL, B2+T, B2+P, BL+T, BL+P, T+P, B2+BL+T, B2+BL+P, B2+P+T, BL+P+T or B2+BL+P+T.

Figure 4:
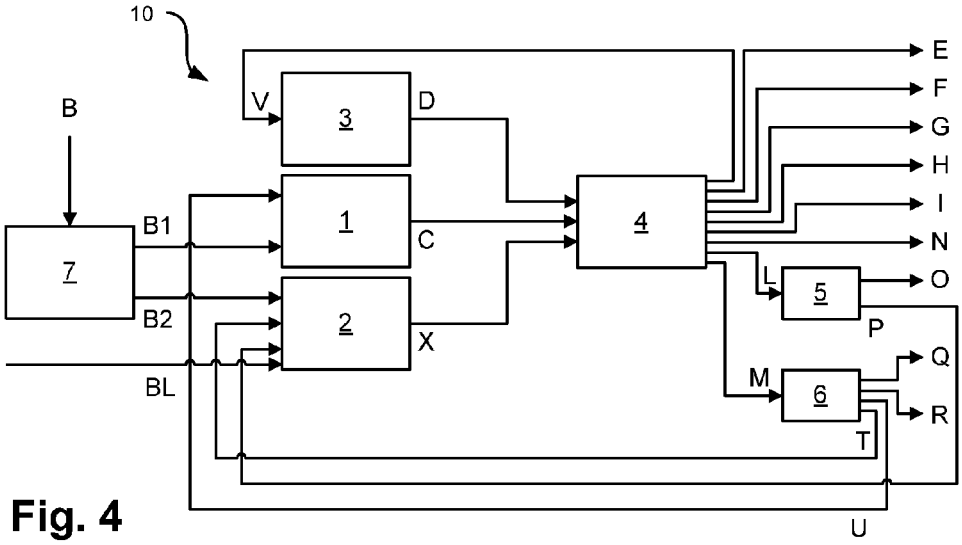

A particularly advantageous configuration of the invention is likewise present in FIG. 4. FIG. 4 has the same schematic process flow diagram as also shown in FIG. 3. This is supplemented by a cracking furnace 3 for gaseous input, into which a fraction V is conducted as input. The fraction V comprises saturated gaseous hydrocarbons having a carbon number of 2 or 3, which are likewise obtained in the processing unit 4.

Figure 5:
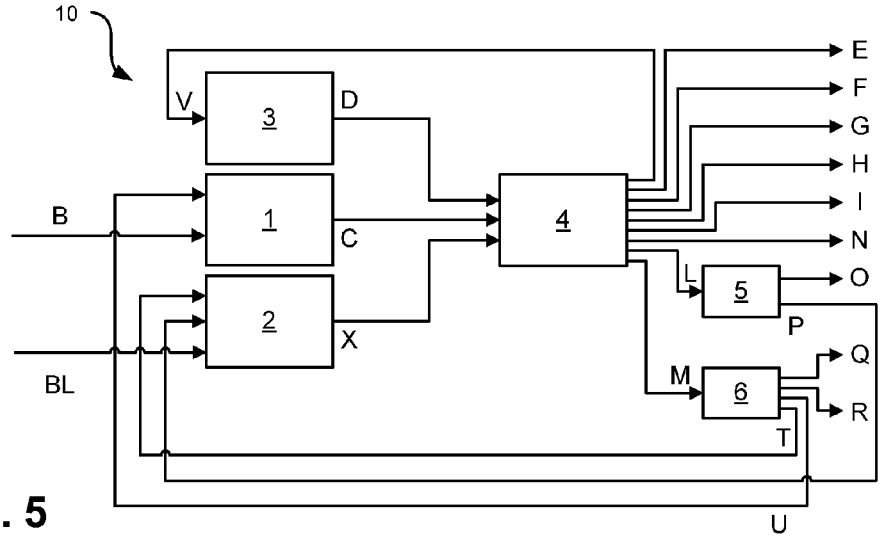

FIG. 5 too shows an advantageous configuration of the invention. FIG. 5 includes the same schematic process flow diagram as FIG. 3, except that the fresh input fractionation is absent here. Fresh input is added here as fresh input B to the first cracking furnace 1, and a fresh input BL composed of hydrocarbons having a maximum carbon number of 6, preferably a maximum of 5, is added to the second cracking furnace 2. The further process steps have already been elucidated in the figure description for FIGS. 2 and 3.

LIST OF REFERENCE NUMERALS

1 cracking furnace (normal cracking conditions)
2 cracking furnace (mild cracking conditions)
3 cracking furnace for gaseous input
4 processing unit
5 C4 processing unit
6 pyrolysis gasoline processing unit
7 fresh input fractionation unit
10 schematic process flow diagrams for a known process
100 schematic process flow diagrams for the process according to the invention in particularly advantageous configurations
A, B, BL fresh input
B1, B2 fresh input fractions
C, D, X product streams
E-V product fractions

The invention claimed is:

1. A process for converting hydrocarbon inputs by thermal steamcracking to give at least one olefin-containing product stream comprising at least ethylene and propylene, by at least partly converting a hydrocarbon input in at least one cracking furnace (2), characterized in that the hydrocarbon input is converted under mild cracking conditions in the cracking furnace (2), mild cracking conditions meaning that propylene to ethylene are present in a ratio of 0.85 to 1.6 kg/kg at the cracking furnace exit, and the hydrocarbon input comprising predominantly hydrocarbons having a maximum carbon number of 5.

2. The process as claimed in claim 1, characterized in that the cracking furnace (2) which converts under mild cracking conditions is supplied with one or more recycled fractions (P, T) which are obtained from the product stream and which comprise predominantly hydrocarbons having a maximum carbon number of 5 as the hydrocarbon input.

3. The process as claimed in claim 1 or 2, characterized in that the recycled fractions (P, T) are substantially free of diolefins when they are supplied to the cracking furnace (2) which converts under mild cracking conditions as the hydrocarbon input.

4. The process as claimed in claim 1, characterized in that the cracking furnace (2) which converts under mild cracking conditions is supplied with predominantly saturated hydrocarbons as the hydrocarbon input.

5. The process as claimed in claim 1, characterized in that the hydrocarbon input is converted in the cracking furnace (2) under mild cracking conditions that lead to a ratio of propylene to ethylene of up to 1.2 kg/kg, at the cracking furnace exit.

6. The process as claimed claim 1, characterized in that a hydrocarbon input is converted under normal cracking conditions in a further cracking furnace (1), normal cracking conditions meaning that propylene to ethylene are present in a ratio of 0.25 to 0.85 kg/kg, preferably of 0.3 to 0.75 kg/kg and more preferably of 0.4 to 0.65 kg/kg at the cracking furnace exit, the ratio of propylene to ethylene for the cracking furnace (2) which converts under mild cracking conditions always having a greater value than the value for the ratio of propylene to ethylene for the cracking furnace (1) which converts under normal cracking conditions.

7. The process as claimed in claim 6, in which the values for the ratio of propylene to ethylene differ by at least 0.1 kg/kg, preferably by at least 0.15 kg/kg, more preferably by at least 0.2 kg/kg.

8. The process as claimed in claim 1, characterized in that the composition of a hydrocarbon input which is used for the cracking furnace (1) which converts under normal cracking conditions differs from that of the hydrocarbon input which is used for the cracking furnace (2) which converts under mild cracking conditions.

9. The process as claimed in claim 1, characterized in that the cracking furnace (1) which converts under normal cracking conditions is supplied with at least one fraction (U) which has been separated from the product stream and recycled, comprising predominantly hydrocarbons having a carbon number of at least 6.

10. The process as claimed in claim 1, characterized in that a fresh input is used, which is fractionated into at least one first and one second fresh input fraction (B1, B2), and the first fresh input fraction (B1) is conducted at least partly into the cracking furnace (1) which converts under normal cracking conditions and the second fresh input fraction (B2) at least partly into the cracking furnace (2) which converts under mild cracking conditions.

11. The process as claimed in claim 1, in which the cracking furnace exit temperature for the conversion in the cracking furnace (2) which converts under mild cracking conditions is between 680° C. and 820° C., preferably between 700° C. and 800° C. and further preferably between 710° C. and 780° C. and more preferably between 720° C. and 760° C., and the cracking furnace exit temperature for the conversion in the cracking furnace (1) which converts under normal cracking conditions is between 800° C. and 1000° C., preferably between 820° C. and 950° C. and more preferably between 840° C. and 900° C., the cracking furnace exit temperature of the cracking furnace (1) which converts under normal cracking conditions being at least 10°

C. above, preferably at least 20° C. above, that of the cracking furnace (2) which converts under mild cracking conditions.

12. The process as claimed in claim 1, in which 0.3 to 1.5 kg of steam per kg of hydrocarbon input is used in the cracking furnace (1) which converts under normal cracking conditions, and 0.15 to 0.8 kg of steam per kg of hydrocarbon input in the cracking furnace (2) which converts under mild cracking conditions.

13. The process as claimed in claim 1, in which at least one fraction (V) comprising predominantly hydrocarbons having a carbon number of 2 or 3 is obtained from the product stream and at least partly converted in a cracking furnace (3) for gaseous input.

14. The process as claimed in any of claim 1, characterized in that the fresh input (BL) conducted into the cracking furnace (2) which converts under mild cracking conditions comprises natural gas condensates or/and one or more cuts from a mineral oil refinery and/or synthetic and/or biogenic hydrocarbons and/or mixtures derived therefrom.

15. The process as claimed in claim 1, characterized in that the fresh input (B) used for the cracking furnace (1) which converts under normal cracking conditions or/and for the fresh input for the fresh input fractionation (7) comprises natural gas condensates and/or crude oil fractions, especially naphtha, and/or synthetic and/or biogenic hydrocarbons and/or mixtures derived therefrom.

* * * * *